US012208957B2

(12) United States Patent
Bisio

(10) Patent No.: US 12,208,957 B2
(45) Date of Patent: Jan. 28, 2025

(54) CAPSULE WITH CONTROLLED OPENING FOR THE PREPARATION OF BEVERAGES

(71) Applicant: BISIO PROGETTI S.P.A., Alessandria (IT)

(72) Inventor: Luigi Bisio, Alessandria (IT)

(73) Assignee: BISIO PROGETTI S.P.A., Alessandria (IT)

( * ) Notice: Subject to any disclaimer, the term of this patent is extended or adjusted under 35 U.S.C. 154(b) by 554 days.

(21) Appl. No.: 17/614,760

(22) PCT Filed: May 20, 2020

(86) PCT No.: PCT/IB2020/054770
§ 371 (c)(1),
(2) Date: Nov. 29, 2021

(87) PCT Pub. No.: WO2020/245685
PCT Pub. Date: Dec. 10, 2020

(65) Prior Publication Data

US 2022/0227575 A1 Jul. 21, 2022

(30) Foreign Application Priority Data

Jun. 4, 2019 (IT) ..... 102019000007962

(51) Int. Cl.
*B65D 85/804* (2006.01)

(52) U.S. Cl.
CPC ..... *B65D 85/8055* (2020.05); *B65D 85/8052* (2020.05)

(58) Field of Classification Search
CPC ..... B65D 85/804–8067
See application file for complete search history.

(56) References Cited

U.S. PATENT DOCUMENTS

2018/0296024 A1 10/2018 Bisio
2019/0202628 A1* 7/2019 Bisio ..... A47J 31/407

FOREIGN PATENT DOCUMENTS

WO 2016193961 A2 12/2016
WO 2018025120 A1 2/2018

OTHER PUBLICATIONS

International Search Report for International Patent Application No. PCT/IB2020/054770 filed May 20, 2020, mailed Aug. 7, 2020.
Reply to the Written Opinion of the International Searching Authority for International Application No. PCT/IB2020/054770, Dated Dec. 23, 2020.

(Continued)

*Primary Examiner* — Lyle Alexander
*Assistant Examiner* — Chaim A Smith
(74) *Attorney, Agent, or Firm* — CANTOR COLBURN LLP

(57) ABSTRACT

A capsule for the preparation of infusion or instant beverages includes pushing means for lifting a disc, arranged at a bottom of a cup defining an internal volume for containing a food substance to be infused. A central portion is collapsible towards the inside of the cup under a pressure force exerted from outside. The disc is fixed to an external edge with a peelable weld. Collapse of an intermediate portion pushes the disc, which, by lifting itself, detaches from the external edge, forming an outlet passage for the beverage.

12 Claims, 8 Drawing Sheets

(56) References Cited

OTHER PUBLICATIONS

Written Opinion of the International Searching Authority for International Patent Application No. PCT/IB2020/054770 filed May 20, 2020, mailed Aug. 7, 2020.
International Preliminary Report on Patentability for International Patent Application No. PCT/IB2020/054770 filed May 20, 2020, mailed Feb. 25, 2021.

* cited by examiner

CAPSULE WITH CONTROLLED OPENING FOR THE PREPARATION OF BEVERAGES

CROSS-REFERENCE TO RELATED APPLICATIONS

This application is a National Phase Application of PCT International Application PCT/IB2020/054770, having an International Filing Date of May 20, 2020 which claims priority to Italian Application No. 102019000007962 filed Jun. 4, 2019, each of which is hereby incorporated by reference in its entirety.

FIELD OF THE INVENTION

The present invention relates to a capsule for the preparation of infusion or instant beverages.

In particular, the present invention relates to a capsule for the packaging of concentrated products (for example in the form of powder, granules, leaves) in predetermined and single-use doses, for the extemporaneous preparation of beverages (such as tea, coffee, herbal teas, milk, chocolate, etc.) by means of the introduction, inside the capsule itself, of a pressurized fluid (mostly hot water).

BACKGROUND OF THE INVENTION

In the field of capsules or pods for coffee or other infusions it is well known to use automatic or semi-automatic machines provided with a dispensing unit capable of producing an infusion through the passage of hot water under pressure through the capsule containing precisely the essence to be infused or dissolved.

The common operating principle of these machines involves the perforation of the lid closing the capsule to allow the insertion of a flow of hot water under pressure by the infuser unit. Once the infusion of the essence contained inside the capsule has been achieved, the infused beverage comes out of the capsule and is directed by the machine into the cup or final container.

Capsules with mechanical opening, i.e. in which the opening for the outlet of the beverage is activated by a force external to the capsule, are known in the industry. These known capsules are provided with a layer of sealing film, usually made of aluminum, placed at the bottom of the capsule at a base provided with one or more cutting or severing points or profiles. When the capsule is inserted into the infusion chamber of the extraction machine, the beating of the capsule against the wall of the infusion chamber activates the opening means, i.e. the points or severing profiles inside the capsule, which engage against the aluminum layer until they perforate or tear. Once the opening is created through the sealing film layer, the infused beverage may escape through a suitable opening in the base of the capsule.

These known capsules are quite complex from a construction point of view, especially with regard to the forming of the tips or the cutting/severing profiles on the base. Therefore, the known capsules are rather costly, especially when it comes to producing the relevant molds. Moreover, in such capsules where the opening is obtained by perforating the sealing film, there is a risk that the tip that made the opening, said tip remaining inside the opening itself, will obstruct it, thus compromising the correct dispensing of the beverage.

Alternatively, capsules are known which do not have actual tips per se, but have cutting or severing profiles, in which case the opening is obtained by tearing the sealing film. However, in such capsules it is difficult to control the course of the tear, which could undesirably extend to other areas of the base, for example at the labyrinth intended to prevent dripping, compromising its function. Furthermore, uncontrolled tearing could also lead to the detachment of portions of the sealing film, which could escape from the capsule along with the beverage.

SUMMARY OF THE INVENTION

The object of the present invention is to provide a capsule for the preparation of infusion or instant beverages that solves the problems in the known prior art.

In particular, the object of the present invention is to provide a capsule that guarantees greater control during opening, as well as simpler and less costly production while achieving similar performance in terms of quality of the infused beverage.

This object is achieved by a capsule in which the opening for the release of the infused beverage is made following the detachment of the sealing disc placed inside the capsule by way of pushing means activated by a force external to the capsule, thus avoiding the use of any perforation or severing means as are provided in known capsules.

This object is achieved by a capsule for the preparation of infusion or instant beverages and by a method for preparing an infused beverage as described and claimed herein. Preferred embodiments of the disclosure are also described.

BRIEF DESCRIPTION OF THE FIGURES

The characteristics and advantages of a capsule for the preparation of infusion or instant beverages according to the present invention will become evident from the description below, given by way of example and without limitation in accordance with the accompanying drawings, in which.

DETAILED DESCRIPTION

Figure 1A:
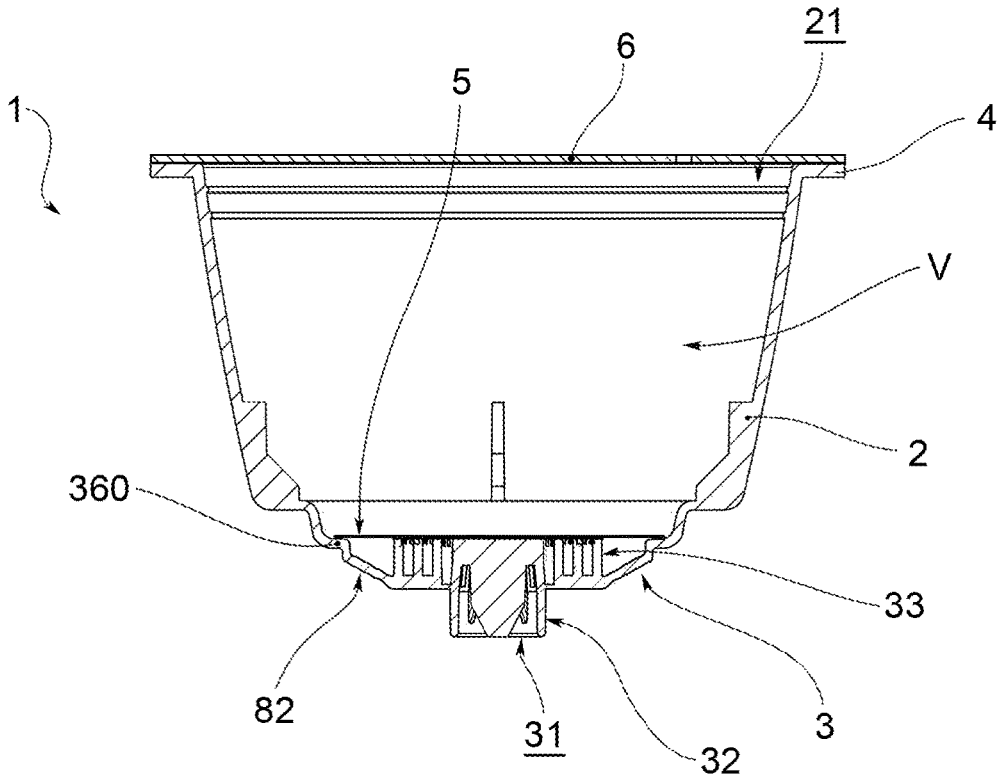
FIGS. 1*a* and 1*b* show a sectional view of a capsule according to the present invention before and after opening, respectively.
Figure 1B:
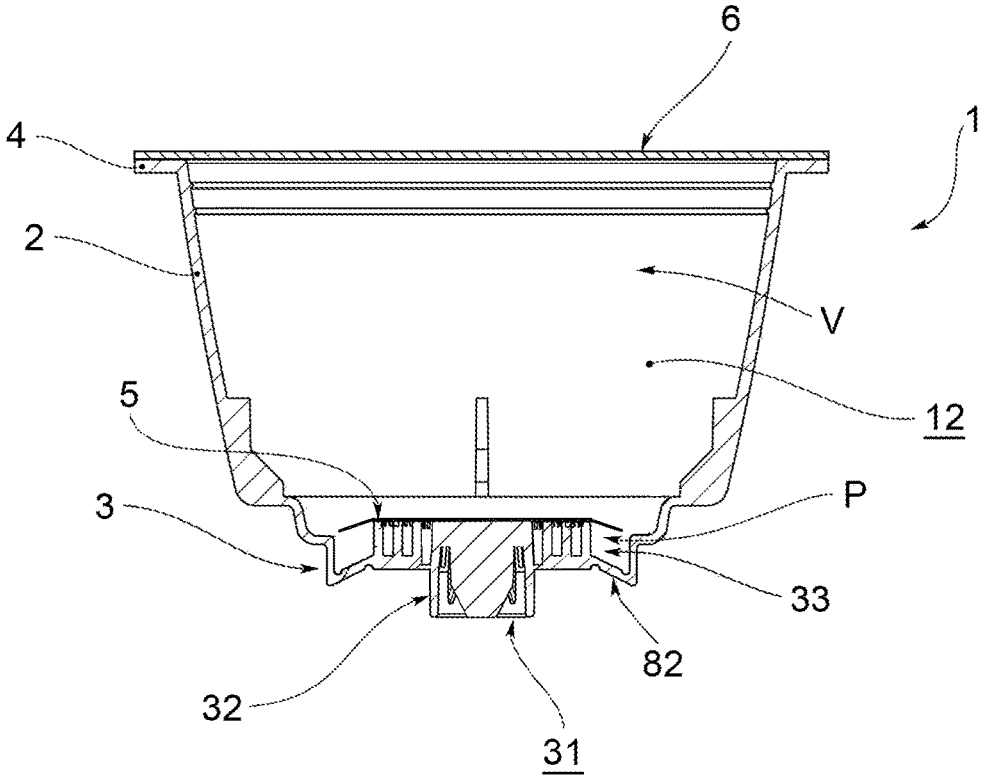

With reference to the accompanying drawings, and in particular FIGS. 1*a* and 1*b*, a capsule for the preparation of infusion or instant beverages, denoted by reference sign 1, is shown.

The capsule 1 comprises a body or cup 2 adapted to define an internal volume V for containing at least one substance to be infused or dissolved, typically in powder or granular form.

The cup 2 is provided, on one side, with a bottom 3 and, on the opposite side, with an inlet opening 21 defined by an edge 4 protruding outwards.

The capsule 1 comprises a lid 6 fixed, by gluing or welding, to the edge 4 in order to seal the cup 2 at the top.

The cup 2 is provided, at the bottom 3, with an outlet opening 31, defined by a nozzle 32, which allows the infused beverage to escape.

The cup 2 is provided internally, at the bottom 3, with a base 33 provided with a plurality of reliefs 310, 320, 330, 340, 350, 360, vertically protruding from said base 33.

The upper surface of the reliefs 310, 320, 330, 340, 350, 360 is substantially flat and free from cutting or puncturing or tearing elements. In addition, the reliefs 310, 320, 330, 340, 350, 360 have smooth and rounded edges.

Preferably, the reliefs 310, 320, 330, 340, 350, 360 all have substantially the same vertical extent.

On the upper surface of at least some of the reliefs 310, 320, 330, 340, 360, a sealing disc 5 is fixed by gluing or welding.

Figure 2:
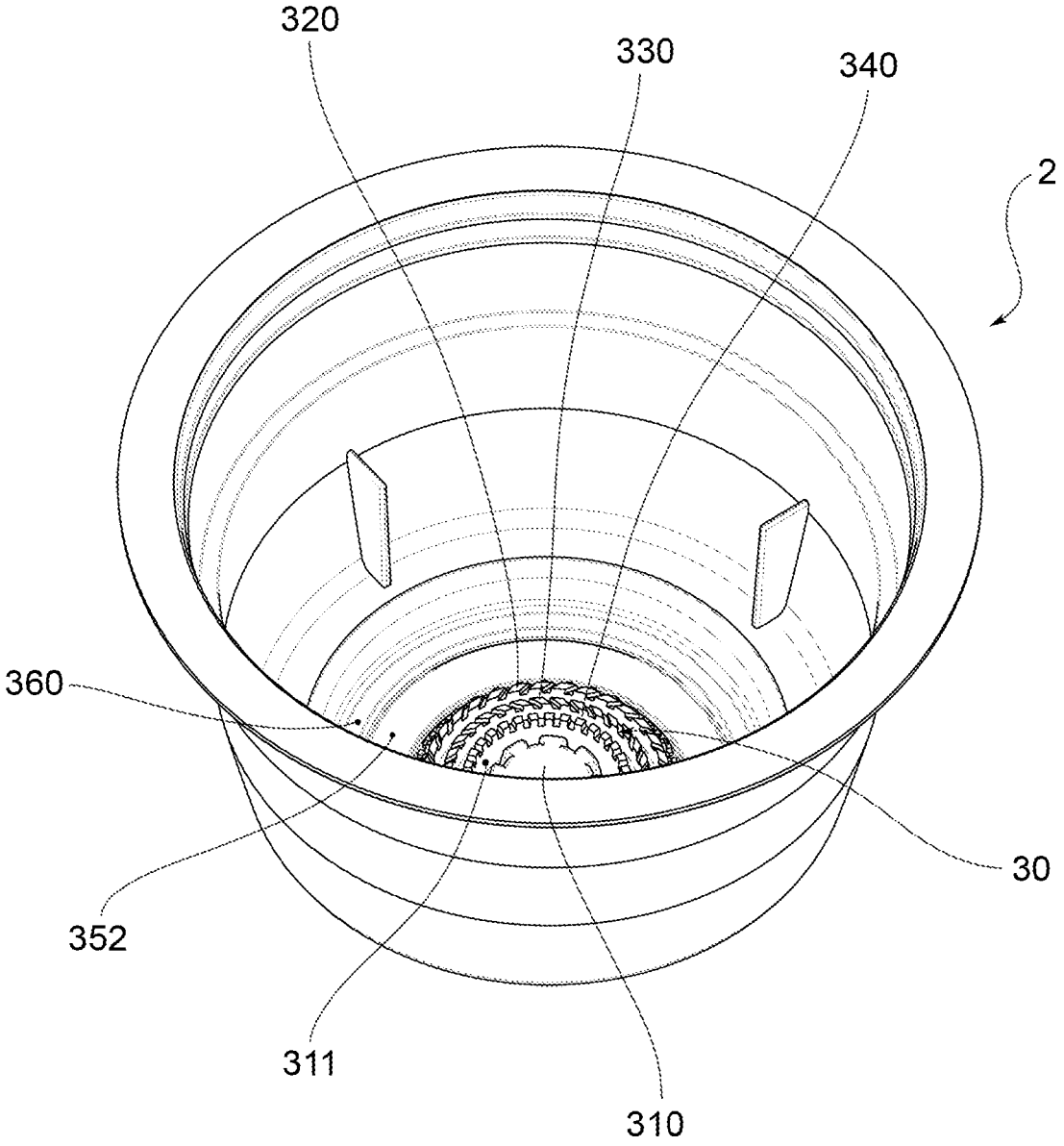
FIG. 2 shows a perspective view from above of a cup for a capsule according to the present invention, in a first exemplary embodiment.

As shown for example in FIG. 2, the base 33 comprises a central portion 310, defined by a first relief, covering the outlet opening 31 of the nozzle 32. The central portion 310 is provided with at least one opening 311 connecting the inside of the cup 2 to the outlet opening 31 to allow the infused beverage to flow out of the capsule 1. Preferably, the central portion 310 comprises a number of connection openings 311.

The base 33 comprises a labyrinth 30 defined by at least one additional relief 320, 330, 340. The labyrinth is substantially circular in shape and arranged concentrically with respect to the nozzle 32 (and the central portion 310).

Each relief 320, 330, 340 of the labyrinth 30 is provided with a plurality of preferably diagonal grooves, provided on the upper surface of each relief of the labyrinth, adapted to allow the infused beverage to flow out of the capsule 1.

In the example shown in FIGS. 1 and 2, the labyrinth 30 is defined by a first labyrinth portion 320, a second labyrinth portion 330 and a third labyrinth portion 340 arranged concentrically with respect to the nozzle 32.

In an example (not shown), the labyrinth 30 is formed by a single, annular relief provided with radial grooves in a zigzag pattern.

Advantageously, when a sealing disc 5 is fixed to the upper surface of the labyrinth 30, the plurality of grooves of the labyrinth provide an anti-drip function, utilizing the principle of capillary action.

The base 33 comprises an external edge 360, defined by an additional relief, on which a sealing disc 5 is fixed by gluing or welding.

In one exemplary embodiment, shown in FIG. 2, the base 33 comprises a collection compartment 352 for the outflow of the infused beverage outside the capsule 1. The collection compartment 352, defined between the labyrinth 30 and the edge 360, is an annular groove lowered with respect to the labyrinth 30 and the edge 360.

Figure 3:
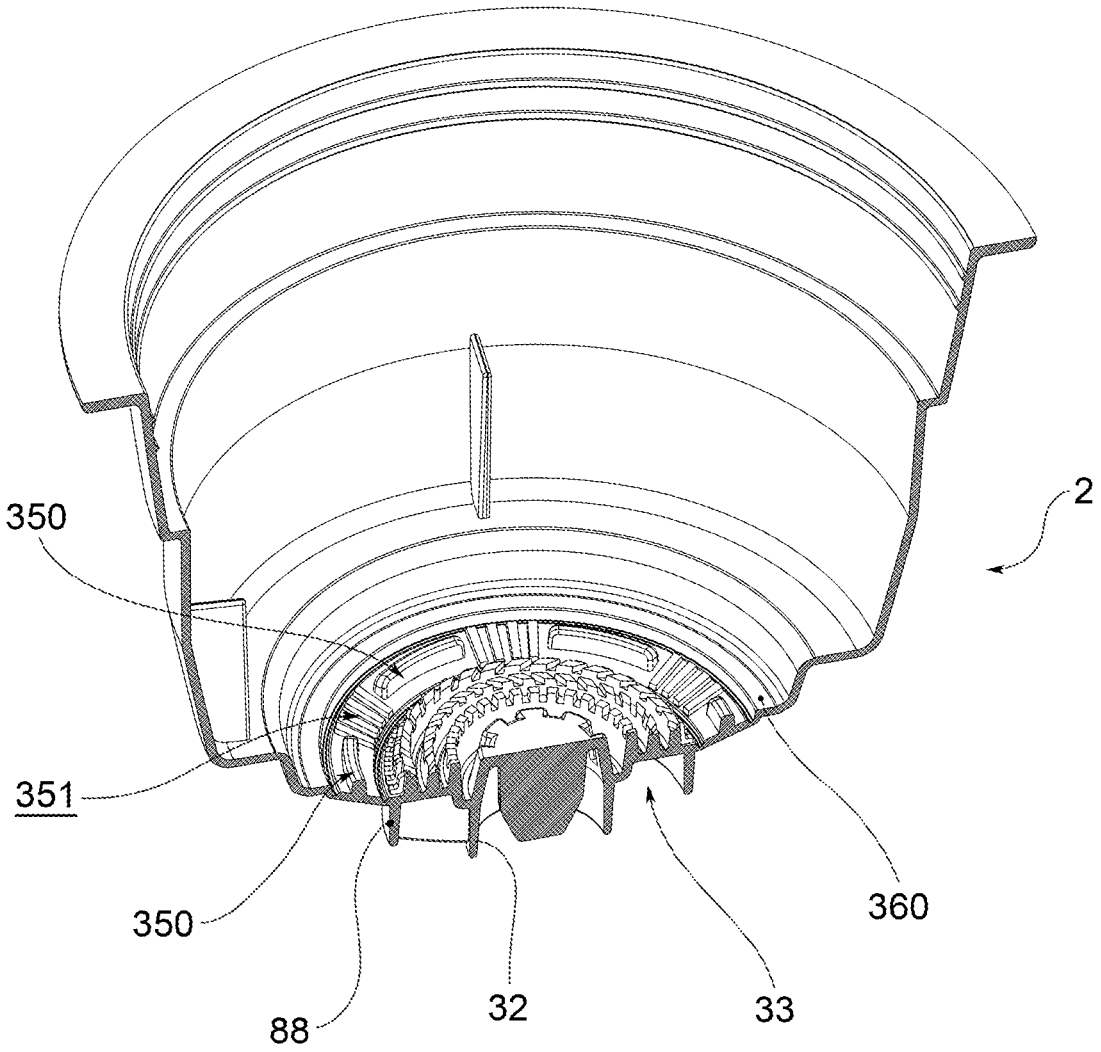
FIG. 3 shows a perspective view from above of a cup for a capsule according to the present invention, in a second exemplary embodiment.
Figure 3A:
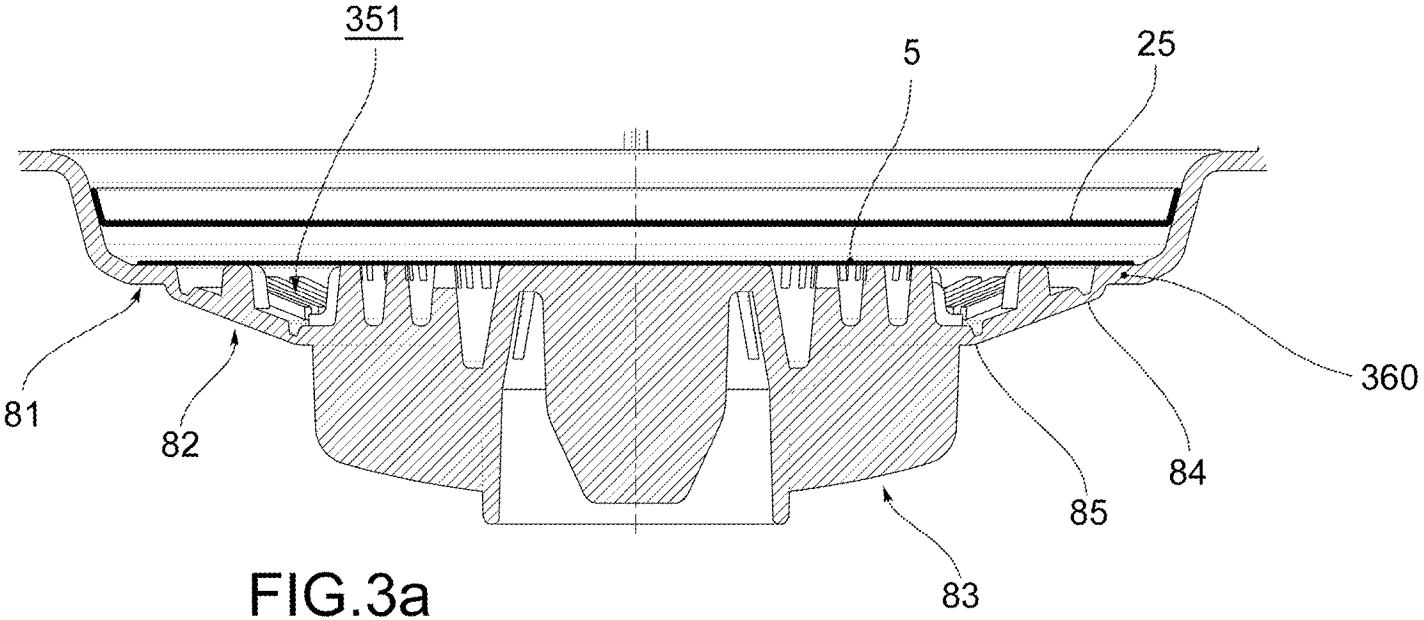
FIGS. 3*a* and 3*b* show a sectional view of a capsule provided with the cup from FIG. 3 and an internal sealing disc before and after opening, respectively.
Figure 3B:
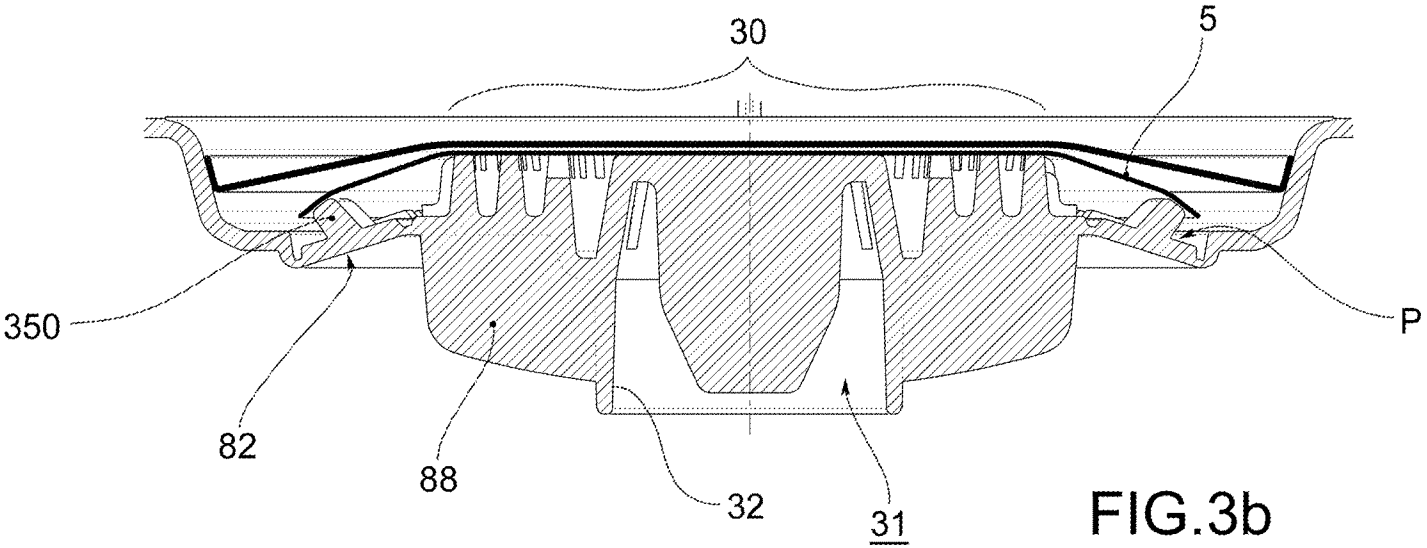
Figure 4:
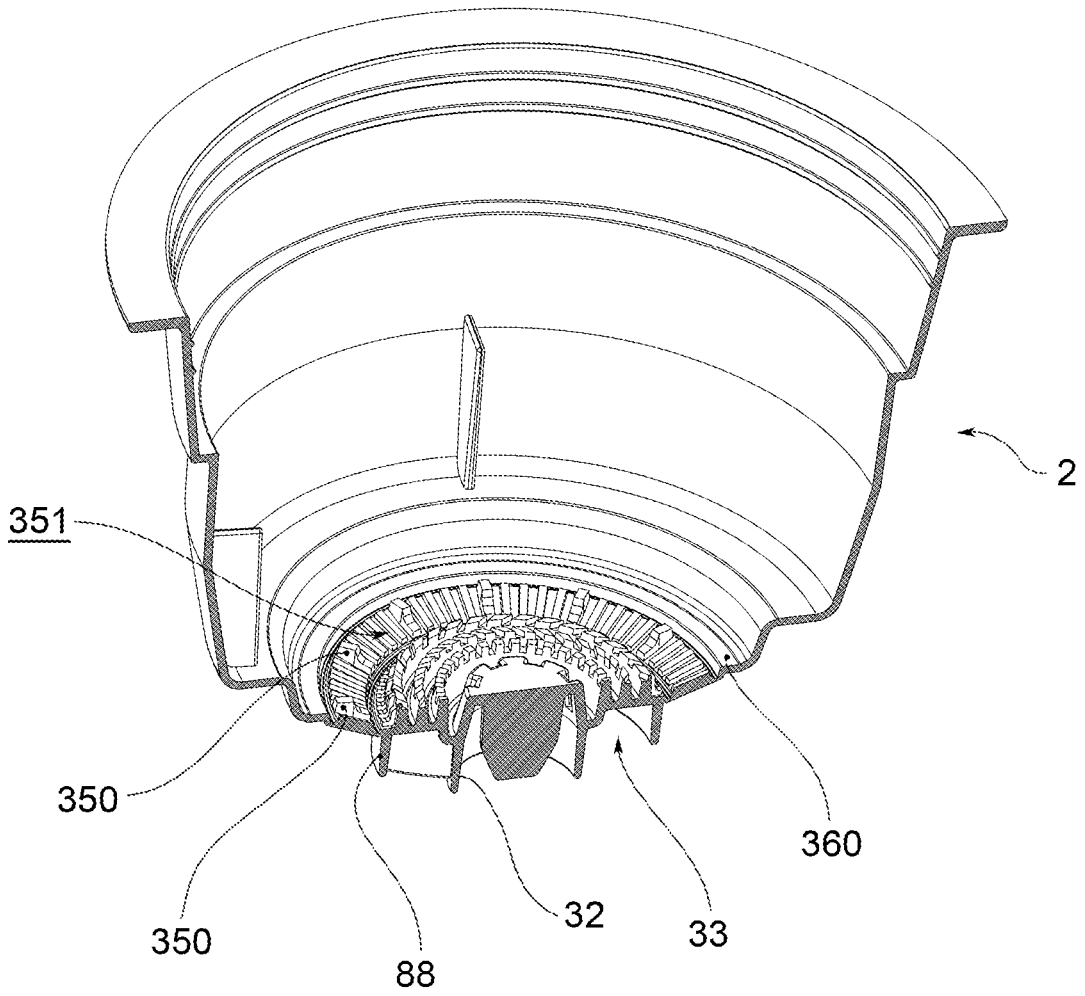
FIG. 4 shows a perspective view from above of a cup for a capsule according to the present invention, in a third exemplary embodiment.
Figure 4A:
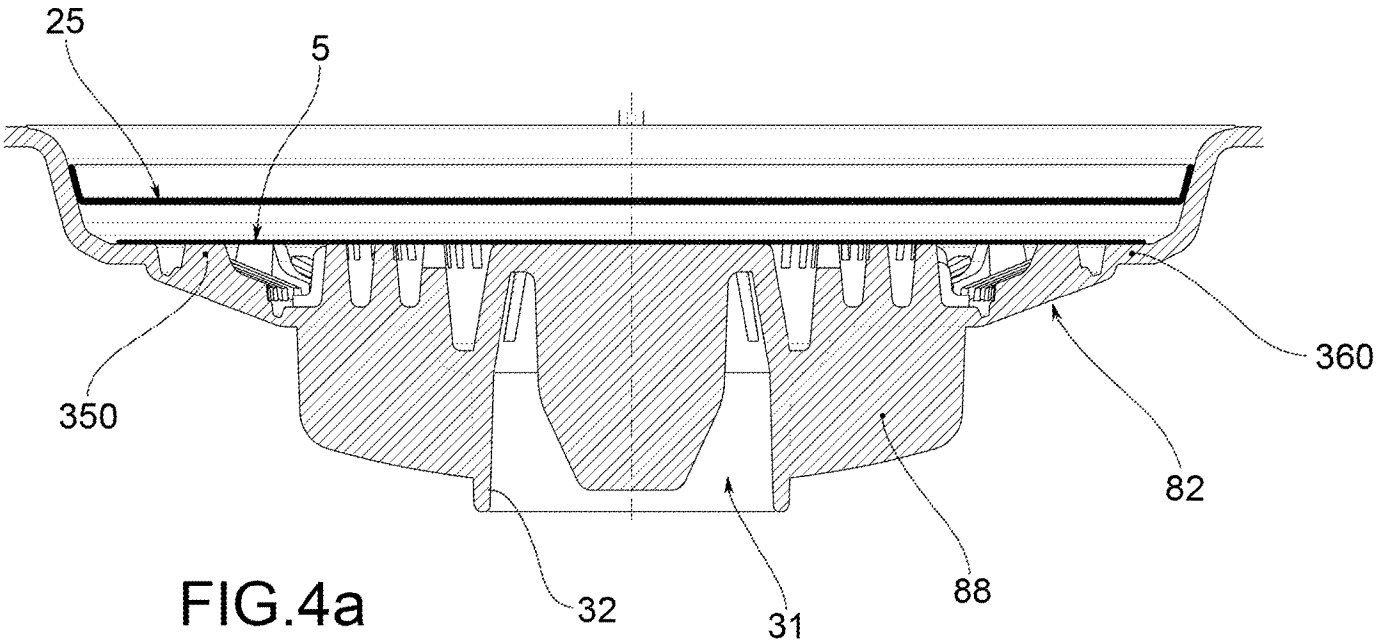
FIGS. 4*a* and 4*b* show a sectional view of a capsule provided with the cup shown in FIG. 4 and of an internal sealing disc before and after opening, respectively.

In a different exemplary embodiment, shown in FIGS. 3 and 4, the base 33 also comprises a plurality of sectors 350, defined by further reliefs, arranged between the labyrinth 30 and the edge 360, inside the collection compartment 352.

In the example of FIG. 3, the sectors 350 are arranged circumferentially with respect to the nozzle 32.

In the example of FIG. 4, the sectors 350 are arranged radially with respect to the nozzle 32.

The sectors 350 are advantageously smooth and free of cutting or puncturing or tearing elements.

In one exemplary embodiment, the sealing disc 5 is supported on the upper surface of the sectors 350.

In one exemplary embodiment, the sectors 350 are provided with a substantially flat upper surface.

In one variant, the sectors 350 have substantially the same vertical extent as the other reliefs 310, 320, 330, 340 that form the base 33. In a different variant, the sectors 350 have a shorter vertical extent, that is to say they are lowered as compared to the other reliefs 310, 320, 330, 340 that form the base 33.

The sectors 350 define a plurality of compartments 351, or compartments or spaces, which allow the infused beverage to flow out of the capsule 1. In particular, a compartment 351 is defined between a pair of adjacent sectors 350. The presence of the sector 350 allows the disc 5 to be supported in such a way as to ensure an adequate width of the passage for the correct and easy outflow of the infused beverage.

Advantageously, since the disc rests only on the upper surface of the sectors 350, without being welded or glued thereto, it may slide freely during the axial displacement generated by the pushing means actuated by a pressure force outside the capsule.

Capsule 1 comprises a sealing disc 5, fixed inside the cup 2 at the bottom 3, adapted to seal the cup 2 at the bottom. The disc 5 is positioned between the internal volume V and the reliefs 310, 320, 330, 340, 350, 360.

The capsule 1 is therefore provided with a sealed chamber 12, which is defined at the top by the lid 6 and at the bottom by the disc 5, and inside which the substance to be infused or dissolved is contained.

The presence of a hermetically sealed chamber 12 is important for the good maintenance and preservation of the substance: the hermetically sealed chamber 12 allows the organoleptic properties of the substance to be infused or dissolved to be maintained over time, and ensures an optimal quality of the infused beverage. An essential element for obtaining a hermetically sealed chamber 12 is the correct gas tightness of the fixing system of the sealing disc 5 inside the capsule 1.

Preferably, the sealing disc 5 is formed by a single disc portion, that is to say it is a single piece.

The disc 5 is fixed at the base 33 of the cup 2, in particular at the outer edge 360, in a yielding, that is to say peelable, manner such that it is detached from the outer edge 360 when pushed (lifted) by pushing means actuated by a force external to capsule 1.

The yielding or peelable fixing is achieved, for example, by the use of a heat-sealing lacquer with a low level of adhesion, or by an adhesive with a low level of adhesion, or by a weakened weld referred to as being peelable.

Preferably, the weld is of the peelable weld type and ensures a lower release force than a traditional weld.

In one exemplary embodiment, the peelable weld is obtained by introducing a percentage of different material, referred to as a contaminant (or even pollutant), into the material making up the lower layer of the disc 5 (material corresponding to that of the base 33 on which the disc 5 is to be fixed) in order to obtain a weakening of the weld.

For example, the capsule is made of polypropylene (PP) and the bottom layer of the disc 5 is a polypropylene compound with polyethylene as the pollutant (PP/PE compound). The polyethylene (PE) in the layer of the disc 5 that is to be in contact with the bottom of the capsule is used to make the disc 5 incompatible with the capsule, which is made of polypropylene. The polyethylene (PE) introduced into the disc 5 aims to create a discontinuity of interaction during the welding phase, which results in a lower sealing force of the weld itself, exploiting the concept of incompatibility between polyethylene (PE) and polypropylene (PP).

In a preferred example, the bottom layer of the disc is a polypropylene compound with polyethylene as a pollutant (or other component that is not very compatible with polypropylene) present in a percentage between 3% and 25%, preferably between 8% and 20%, even more preferably between 10% and 15%.

In a different exemplary embodiment, the peelable weld is obtained by using, as the material making up the bottom layer of disc 5, a material different from the one used for the base 33 on which the disc 5 is to be fixed.

In the capsule 1, the disc 5 is permanently fixed on the labyrinth 30, or at least on the outermost relief 340 that forms the labyrinth 30. This permanent weld prevents the sealing disc 5 from detaching or separating from the labyrinth, which would compromise the anti-drip function.

The disc 5 is preferably permanently glued or welded also to the central portion 310.

In the exemplary embodiment with sectors 350 (FIGS. 3 and 4), the disc 5 is only resting, without being fixed (either in peelable fashion or permanently), above the sectors 350.

The capsule 1 for the preparation of infusion or instant beverages, also comprises means for pushing the sealing disc 5, operated before the injection of the fluid under pressure into the capsule. The pushing means are adapted to push the disc 5 until the peelable weld yields so as to cause the disc 5 to detach from the base 33 and allow the opening of a passage P for the outlet of the infused liquid.

The pushing means are formed at the bottom 3 of the capsule.

The means for pushing the disc comprise a peripheral edge 81, connected by means of a first folding line 84 to an intermediate portion 82, which is connected in turn by means of a second folding line 85 to a central portion 83. The intermediate portion 82 is therefore placed between the peripheral edge 81 and the central portion 83.

It should be noted that at least the central portion is collapsible towards the inside of the cup 2 by rotating around said second folding line 85 under the action of a pressure force exerted from outside the capsule on said central portion 83 and/or on said intermediate portion 82.

Preferably, the intermediate portion 82 is also collapsible towards the inside of the cup 2 by rotating around the first folding line 84 and the second folding line 85, respectively, under the action of the pressure force exerted from outside on the central portion 83 and/or the intermediate portion 82.

It should be noted that:

- the peripheral edge 81 corresponds, at least partially, to the outer edge 360 of the inner base 33;
- the central portion 83 corresponds, at least partially, to the labyrinth 30 and the central portion 310 of the inner base 33;
- the intermediate portion 82 corresponds, at least partially, to the compartment 351,352 of the base 33.

Preferably, the central portion 83 is of circular shape, coaxial with the longitudinal axis of symmetry X of the cup 2. In addition, the pressure force is exerted from outside the capsule 1 at least on the central portion 83 in a direction substantially parallel to the longitudinal axis of symmetry X.

Therefore, starting from the closed operating position of the capsule 1 (shown in particular in FIGS. 1*a*, 2*a*, 3*a* and 4*a*), by applying a pressure force to the central portion 83 and/or the intermediate portion 82, at least the central portion 83 (preferably also the intermediate portion 82) is made to collapse within the volume of the cup 2. The collapse of the central portion 83 results in an axial shift (towards the inside of the cup 2) of the labyrinth 30, to which the disc 5 is permanently fixed. This upward thrust results in a lifting of the disc 5, which lifting causes the peelable weld (at the outer edge 360) to yield and causes a passage P for the outlet of the infused liquid to be opened, consequently bringing the capsule 1 into its dispensing operating position, as shown in FIGS. 1*b*, 2*b*, 3*b* and 4*b*.

Preferably, the pushing means are snap-action means, that is to say the capsule 1 is bistable, i.e. it maintains the closed operating position until the pushing means are activated, and, once open, it maintains the dispensing operating position.

Preferably, the folding lines 84, 85 are formed as narrowed material lines, or as thinned wall portions or grooves in the wall. In addition, the intermediate portion 82 is rigid to allow the snap-action opening.

Preferably, the central portion 83 is provided externally with at least one abutment 88 adapted to strike against a portion of the beverage extraction machine, for example against a wall of the infusion chamber into which capsule 1 is inserted.

The abutment 88 may be made in the form of one or more flaps or a circular collar (as shown in FIGS. 2, 3 and 4).

Preferably, the disc 5 is a plastic film, which does not break or tear due to increased pressure inside the capsule 1.

In use, the capsule 1 is placed in a special seat, generally in the infusion chamber, provided in the extraction machine. When inserting the capsule 1, the abutment 88 protruding from the central portion 83 strikes against the wall of the infusion chamber. When the infusion chamber is closed, the capsule is pushed further against the walls of the infusion chamber, generating a pressure force against the abutment 88, which activates the pushing means.

Alternatively, the capsule 1 may be opened manually by the user prior to its insertion into the extraction machine by applying pressure to the bottom of the cup 2, at the central portion 83 and/or the intermediate portion 82, which pressure activates the pushing means.

The pushing means, activated by the pressure from outside the capsule, push the sealing disc 5 upwards until it detaches (without breakage or tearing) from the edge 360 to which it is fixed in peelable fashion, thus moving the capsule from the closed operating position (as in FIG. 2*a*) to the dispensing operating position (as in FIG. 2*b*), in which the internal volume of the containment body 3 is in communication with the outside of the capsule 1.

A capsule according to the present invention is usable for the packaging of concentrated products (in the form of powder or granules or leaves) in predetermined and single-use doses, for the extemporaneous preparation of beverages such as leaf or instant tea, powdered or instant coffee, herbal teas, milk, chocolate, or other dehydrated and soluble products.

The capsule 1, in its different variants, may be used for the extemporaneous preparation of beverages (such as tea, coffee, herbal teas, milk, chocolate, etc.) by means of automatic or semi-automatic machines provided with a dispensing group capable of producing an infusion by the passage of hot water under pressure through the capsule 1.

Preferably, in the variant of the capsule 1 intended for the preparation of infusion beverages, for example containing coffee powder to be extracted, or tea leaves or herbal teas, there is provided a filter 25, placed between the food substance and the disc 5.

The filter 25 is fixed (at the inner side wall of the cup 2) at a certain distance above the disc 5, so that the pushing means (i.e. the labyrinth 30) do not damage the filter as the capsule is opened.

Advantageously, the presence of the filter slows down the outlet flow of the extraction fluid, which remains for a certain period of time in contact with the substance to be infused or dissolved, so as to ensure an optimal infused beverage.

Figure 5A:
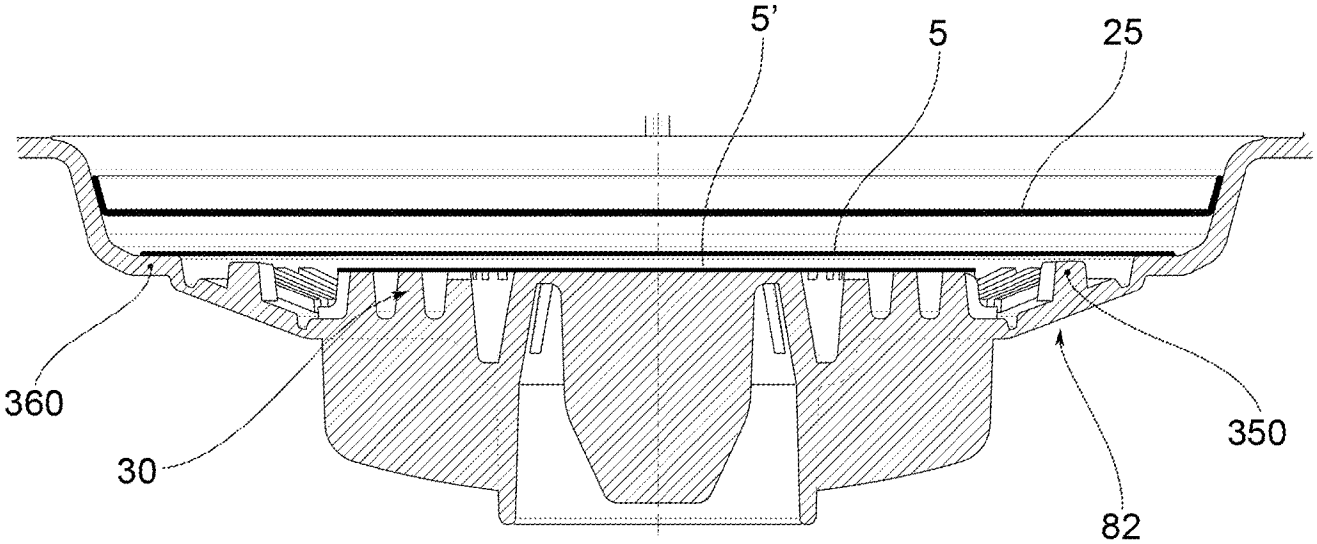
FIGS. 5*a* and 5*b* show a sectional view of a capsule in a further exemplary embodiment before and after opening, respectively.
Figure 5B:
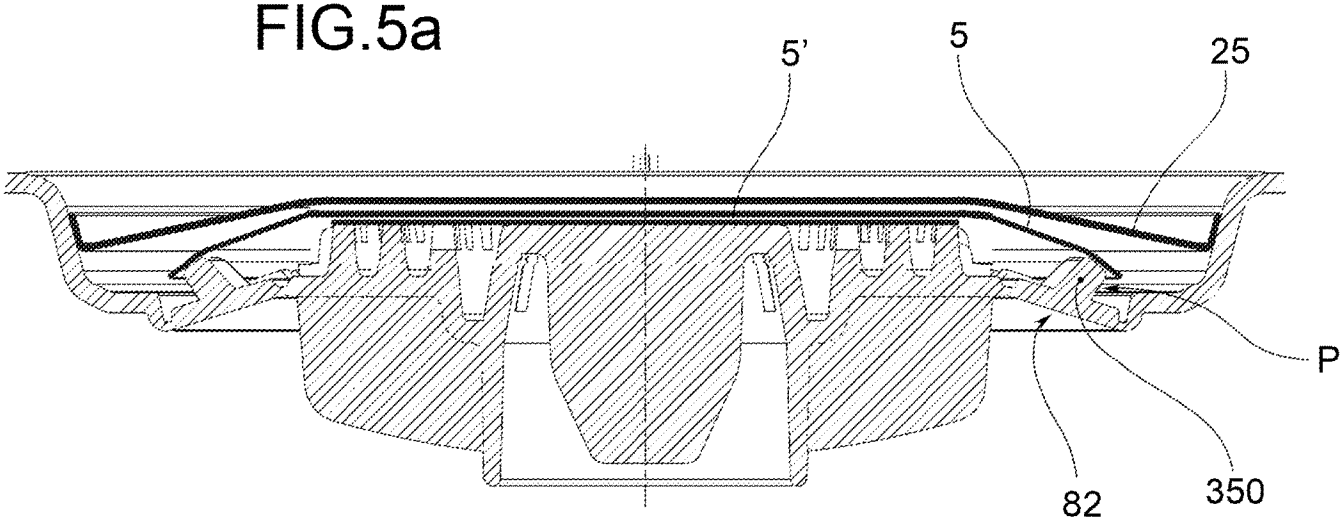

In a further exemplary embodiment, shown in FIGS. 5*a* and 5*b*, the capsule comprises:

- a sealing disc 5 fixed in peelable fashion to the edge 360 in a raised position relative to the labyrinth 30;
- a lower disc 5', permanently fixed on the upper surface of the labyrinth 30 to close the grooves at the top, so that the labyrinth 30 may perform an anti-drip function utilizing the principle of capillary action.

In one example of operation, the labyrinth 30 is a means for pushing the disc 5, that is to say it is the labyrinth 30 that pushes the disc 5 to lift itself away, detaching from the edge 360, so as to form a passage P towards the exit of the capsule.

Figure 4B:
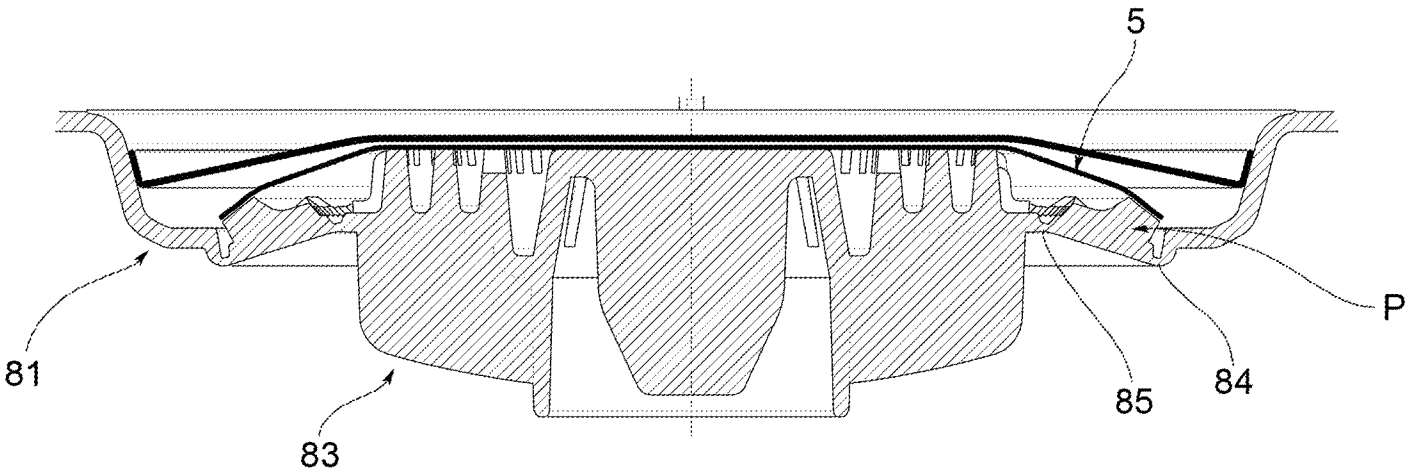

In a further example of operation, the capsule also comprises a plurality of sectors 350 arranged at the intermediate portion 82, and it is the sectors 350 that push the disc 5 to lift away and detach from the edge 360 so as to form a passage P towards the exit of the capsule (FIG. 4*b*).

The present invention also relates to a method for preparing a beverage infused by means of a capsule 1 according to the present invention, in which the opening of a passage for the release of the beverage is obtained by detaching/separating the sealing disc 5 from the edge to which it is fixed, in peelable fashion, by way of pushing means, inside the cup 2, activated by an external pressure acting on the bottom 3 of the capsule.

In particular, the method comprises the steps of:

- activating the pressure means by exerting pressure on said central portion 83 and/or on said intermediate portion until the central portion 83 collapses towards the inside of the cup 2, to lift disc 5 by detaching it from the edge 360 and thus form an outlet passage P for the beverage around disc 5;
- introducing a fluid in the cup 2, through the lid 6, to infuse or dissolve the food substance contained in the internal volume V and thus obtain the beverage.

It should be noted that the pressure means may be activated manually or by inserting the capsule into the extraction machine.

In use therefore, starting from the closed operating position of the capsule 1, by exerting a pressure force on the central portion 83 or on the intermediate portion 82, the central portion 83 is pushed to collapse internally, and with it also the labyrinth 30 to which the disc 5 is fixed. The displacement of the labyrinth 30 causes a lifting of the disc 5 and its consequent detachment from the edge 360 to which it is fixed in peelable fashion, so as to reach the dispensing operating position by opening a passage for the beverage from the internal volume towards outside of the capsule 1, through the nozzle 32.

It should be noted that the outlet passage for the beverage does not pass through the disc 5, but goes around it.

The extraction machine then perforates the lid 6, closing the capsule 1, and inserts, inside the chamber in which the food substance is contained, a fluid (mostly pressurized hot water) intended to infuse or dissolve this food substance to form a beverage. The beverage flows out, through the outflow passage, around disc 5, to the outlet opening 31 to then be directed, through the nozzle 32, into the cup or final container.

In known capsules, due to residual pressure and gas trapped inside the capsule at the end of the extraction, a jet of liquid may escape from the lid through the hole made by the injection needle of the extraction machine. This phenomenon is known in the industry as the "whale effect" and, although it occurs rarely and randomly, it is considered a negative and undesirable effect. First of all, the residual liquid inside the capsule at the end of dispensing is still very hot, and since the splashes are completely uncontrollable, this effect is dangerous for the user, who could burn himself. Furthermore, a leakage of liquid from the lid is also undesirable from the point of view of cleaning the extraction machine, as it could lead to the proliferation of bacteria around or inside the infusion chamber.

The capsule 1 forming the subject of the present invention is advantageously devoid of this "whale effect" which is typical of known capsules.

The capsule 1 is in fact provided with an elastically deformable portion that allows an initial reduction in capsule volume and a subsequent increase to return to the initial volume. The reversibility of the elastically deformable portion allows the capsule 1 to compress and then expand to regain its initial volume.

At the bottom 3, the capsule 1 comprises a collapsible portion 82, 83 towards the inside of the cup 2 under the action of an external pressure force. This collapsible portion 82, 83 is reversible, that is to say it is able to expand again towards the outside of the cup 2 in order to return to its initial configuration under the action of an internal pressure force.

Preferably, the external volume of the capsule is reduced between 1% and 3%. Preferably, the volume reduction occurs at the bottom 3 of the cup 2, while the internal volume V of the compartment in which the food substance to be infused or dissolved remains contained substantially in unchanged form.

Figure 2A:
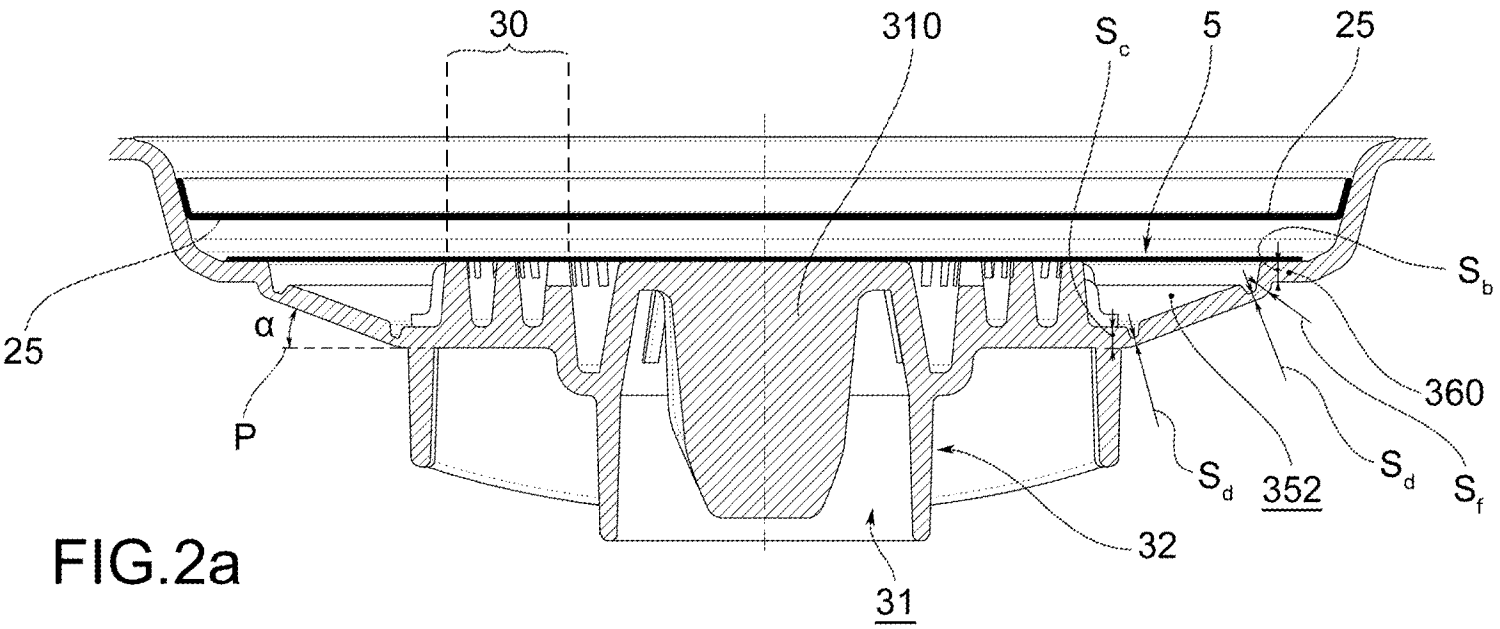
FIGS. 2*a* and 2*b* show a sectional view of a capsule provided with the cup from FIG. 2 and an internal sealing disc before and after opening, respectively.
Figure 2B:
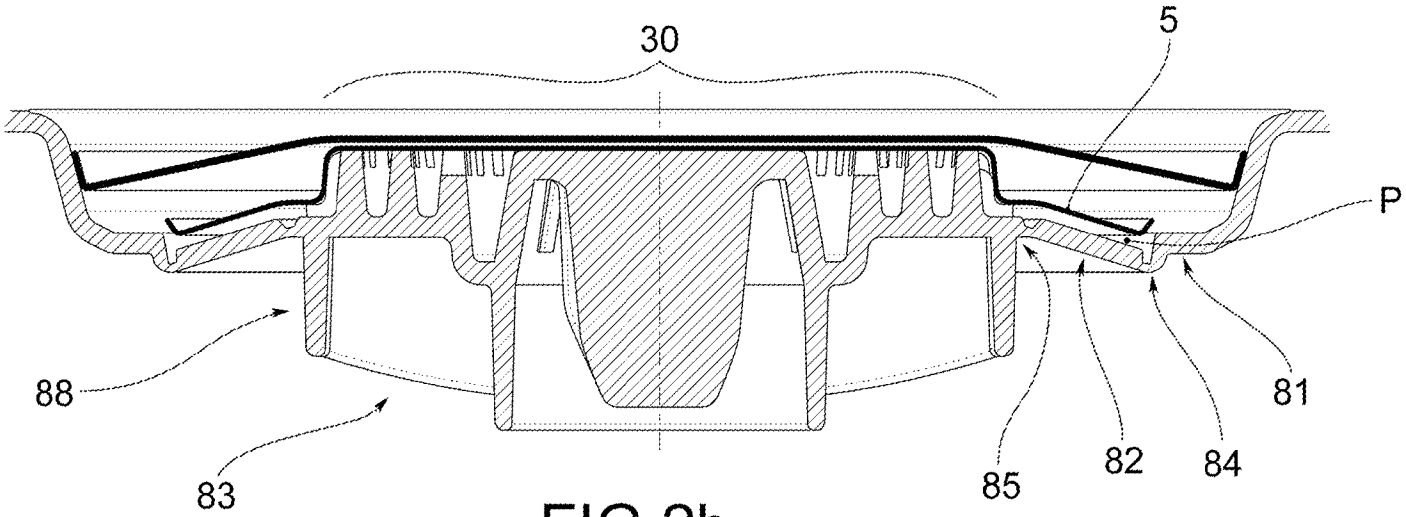

With particular reference to FIGS. 2*a* and 2*b*, the peripheral edge 81 is connected to the intermediate portion 82 by a first folding line 84, and the intermediate portion is connected to the central portion 83 by a second folding line 85. A bending zone is defined between the peripheral edge 81 and the first folding line 84.

The folding line 84, 85, also referred to as a diaphragm, has a thickness Sd between 20% and 60% of the thickness Sc of the central portion 83 or the thickness Sb of the peripheral edge 81, where 20% is the minimum limit to allow the production of the cup 2 by injection molding, and 60% is the maximum limit to avoid excessive rigidity of the diaphragm. Preferably, the folding line 84, 85 has a thickness Sd between 30% and 50% of the thickness Sc of the central portion 83 or the thickness Sb of the peripheral edge 81, and this range represents the best compromise between printability and elasticity of the diaphragm.

In the initial configuration shown in FIG. 2*a*, that is to say before the opening of the capsule 1, the intermediate portion 82 is inclined at an angle $\alpha$ to the horizontal plane B defined by the central portion 83. The intermediate portion 82 is inclined by an angle $\alpha$ comprised between 5° and 45°, where 5° is the minimum limit for the effectiveness of the pushing means (that is to say for the detachment of the disc 5 to open the capsule 1), and 45° is the maximum limit to avoid excessive rigidity of the intermediate portion. Preferably, the intermediate portion 82 is inclined at an angle α of 20°, which is the best compromise for the effectiveness of the pushing means.

The bending zone has a thickness Sf between the thickness Sd of the first folding line 84 and the thickness Sb of the peripheral edge 81. Preferably, the thickness Sf of the bending zone is gradually reduced towards the first folding line 84.

As described above, the capsule 1 is inserted into the infusion chamber of the extraction machine until the bottom 3 of the cup 2 contacts the wall of the infusion chamber. When the infusion chamber is closed, the capsule is pushed further against the walls of the infusion chamber, generating a pressure force acting on the bottom 3 until the collapsible portion 82, 83 collapses into the cup 2. Alternatively, the bottom 3 of the cup 2 may be pushed manually by the user, before insertion into the extraction machine, until the collapsible portion 82, 83 collapses inwards.

At the end of dispensing, the infusion chamber is reopened and the capsule returns to its initial configuration: the residual pressure inside the capsule 1 acts internally on the bottom 3 of the cup 2 until the collapsible portion 82, 83 is re-collapsed outwards. In this way the internal volume of the capsule 1 increases, allowing a decompression of the gas trapped in the cup 2 and a consequent reduction of the pressure inside the capsule itself. This change in the internal volume of the capsule 1 makes it possible to solve the "whale effect" problem.

The use of a collapsible structure at the bottom 3 of the cup 2 as a deformable portion of the capsule 1 allows a reversible reduction of the capsule volume V without compromising the volume of the compartment in which the food substance is contained, which remains substantially unchanged. On the contrary, a deformable portion (for example in the form of a bellows) at the side walls that define the compartment in which the food substance is contained would not only reduce the useful space provided for containing the substance itself, but in the compression phase would generate convex geometries undesirable for the correct extraction of the food substance.

Furthermore, the use of a collapsible structure at the bottom 3 of the cup 2 as a deformable portion of the capsule 1 is advantageously technically simpler from a construction point of view and is producible by injection molding.

Innovatively, a capsule for the preparation of infusion or instant beverages according to the present invention allows precise control of the formation of the beverage outlet passage. In fact, in such a capsule, the beverage outlet passage does not pass through the disc 5, but runs around it, thus avoiding any risk of uncontrolled tearing.

Advantageously, the pushing means are able to exert a high force on the disc, ensuring the safety of the peelable weld as this yields, and therefore ensuring the safety of the opening of a passageway for the outlet of the beverage.

The opening of the capsule is advantageously determined by the disengagement (detachment) of the disc from the base to which it is fixed, which disengagement occurs only at the peelable weld, while no disengagement occurs at the permanent weld, that is to say at the labyrinth intended to exert an anti-drip action.

Advantageously, in the capsule according to the invention, the pushing element of the disc is the labyrinth itself: this solution prevents any detachment of the disc from the labyrinth, which is intended to exert an anti-drip action.

It is clear that a person skilled in the art could make changes to the above-described capsule without departing from the scope of protection as defined by the following claims.

The invention claimed is:

1. A capsule for the preparation of infusion or instant beverages, comprising:

a cup defining an internal volume for containing a food substance to be infused or dissolved, said cup being closed at a top by a lid and provided with a bottom comprising:

an outlet opening for outflow of an infused beverage, an internal base, provided with an external edge and internal reliefs;

a disc, arranged inside the cup, between the food substance and the internal reliefs;

a sealed chamber containing the food substance, said sealed chamber being defined at the top by the lid and at the bottom by the disc fixed to the internal base at the external edge;

pushing means for pushing the disc, arranged at the bottom, comprising a peripheral edge, connected by a first folding line to an intermediate portion, said intermediate portion being connected by a second folding line to a central portion; wherein at least said central portion is collapsible towards inside of the cup by rotating around said second folding line under a pressure force exerted from outside on said central portion and/or on said intermediate portion;

wherein the disc is fixed to the external edge with a peelable weld, and wherein collapse of the intermediate portion towards the inside of the cup pushes the disc which, by lifting itself, detaches from the external edge, forming an outlet passage towards the outlet opening of the cup.

2. The capsule of claim 1, further comprising an anti-drip labyrinth arranged at the central portion, wherein said anti-drip labyrinth is the pushing means for pushing the disc, wherein said anti-drip labyrinth is defined by at least one internal relief provided with an upper surface, and wherein said upper surface is provided with a plurality of grooves, and the disc is permanently fixed on said upper surface.

3. The capsule of claim 2, wherein the at least one internal relief is defined by a first portion, a second portion and a third portion arranged concentrically, each of said labyrinth portions being provided, on the upper surface, with a plurality of diagonal grooves.

4. The capsule of claim 1, comprising:

an anti-drip labyrinth arranged at the central portion, said anti-drip labyrinth being defined by at least one internal relief provided with an upper surface, and wherein said upper surface is provided with a plurality of grooves, and a lower disc is permanently fixed on said upper surface; and a plurality of sectors, defined by further reliefs of the internal base, arranged between the anti-drip labyrinth and the external edge;

wherein said plurality of sectors is the pushing means for pushing the disc.

5. The capsule of claim 1, wherein the central portion is externally provided with at least one abutment on which the pressure force acts.

6. The capsule of claim 1, wherein the disc comprises a lower layer made with a same material as the external edge with addition of a pollutant.

7. The capsule of claim 1, further comprising an elastically deformable portion configured to allow a reversible variation of an external volume of the capsule, said elastically deformable portion being a collapsible portion at the bottom of the cup.

8. The capsule of claim 7, wherein said elastically deformable portion allows a reduction in said external volume of the capsule between 1% and 3%, and wherein said reduction occurs at the bottom of the cup.

9. The capsule of claim 7, wherein said elastically deformable portion is the central portion, which is collapsible towards the outside of the cup by rotating around said second folding line to return to an initial configuration under an internal pressure force.

10. The capsule of claim 1, wherein said first and second folding lines have a thickness between 20% and 60% of the thickness of the central portion or of the thickness of the peripheral edge.

11. The capsule of claim 10, wherein, before opening to allow the infused beverage to escape, the intermediate portion is inclined at an angle comprised between 5° and 45° to a horizontal plane defined by the central portion.

12. The capsule of claim 1, wherein a bending zone is defined between the peripheral edge and the first folding line, said bending zone having a thickness that gradually reduces towards the first folding line.

* * * * *